US006600256B2

(12) United States Patent
Van Lier et al.

(10) Patent No.: US 6,600,256 B2
(45) Date of Patent: Jul. 29, 2003

(54) ELECTRIC LAMP

(75) Inventors: Edwin Van Lier, Eindhoven (NL); Godefridus Nicolaas Maria Verspaget, Eindhoven (NL); Petrus Jacobus Govardus Mies, Eindhoven (NL); Hans-Peter Erich Mews, Lüdenscheid (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 100 days.

(21) Appl. No.: 09/811,644

(22) Filed: Mar. 19, 2001

(65) Prior Publication Data

US 2001/0050523 A1 Dec. 13, 2001

(30) Foreign Application Priority Data

Mar. 22, 2000 (EP) ..... 00201033

(51) Int. Cl.[7] ..... H01J 5/48; H01J 5/50

(52) U.S. Cl. ..... 313/313; 313/318.01; 313/318.04; 313/318.11; 362/296

(58) Field of Search ..... 313/567, 113, 313/318.01, 318.03, 318.04, 318.08, 318.09, 318.1, 318.11, 318.12; 439/602, 611, 615, 624; 362/296, 310, 341

(56) References Cited

U.S. PATENT DOCUMENTS

| | | | | | |
|---|---|---|---|---|---|
| 3,629,640 | A | * | 12/1971 | Salem et al. | 313/318.01 |
| 3,775,634 | A | * | 11/1973 | Hasell et al. | 313/318.01 |
| 5,032,759 | A | * | 7/1991 | Thiry et al. | 313/318.01 |
| 5,057,735 | A | * | 10/1991 | Zalar et al. | 313/113 |
| 6,147,444 | A | * | 11/2000 | Gallant et al. | 313/318.01 |
| 6,384,521 | B1 | * | 5/2002 | Keim et al. | 313/318.04 |

FOREIGN PATENT DOCUMENTS

| | | | |
|---|---|---|---|
| EP | 0758486 B1 | 2/1997 | H01K/1/46 |

* cited by examiner

*Primary Examiner*—Ashok Patel
(74) *Attorney, Agent, or Firm*—Frank Keegan

(57) ABSTRACT

The electric lamp has a light source (20) in an outer bulb (21). The light source (20) is secured in an envelope (1) by means of an insulator body (40) in which current connection conductors (43) are integrated and which is present in a lamp cap (10) of the reflector lamp. The lamp cap (10) is mechanically connected to a neck portion (5) of the envelope (1). The integrated insulator/current connector body (40, 43) enables electrical contacting, fixation, and mechanical adjustment of the light source (20) in the envelope (1).

10 Claims, 2 Drawing Sheets

ELECTRIC LAMP

FIELD OF THE INVENTION

The invention relates to an electric lamp comprising:

an envelope of a light-transmitting material with a neck and a light source;

a lamp cap provided with contacts and fixed around a free end portion of the neck; and current conductors extending from the light source through the free end portion of the neck and electrically connected to the contacts of the lamp cap.

BACKGROUND OF THE INVENTION

Such an electric lamp is known from EP-0 758 486. The known lamp is a reflector lamp because the envelope is internally partly reflectorized. The light source in the known lamp is mechanically fixed in a plate. The plate and the light source are fixed in the neck of the envelope by means of cement. The current conductors passed through the free end portion of the neck issue into the lamp cap, which is hollow. The lamp cap has a helically threaded contact around its axis and a central contact situated on its axis. The current conductors of the light source are flexible and are guided towards the contacts of the lamp cap in the hollow lamp cap, for example in that they are bent, and are fixed to these contacts by means of welding or soldering.

It is a disadvantage of the known lamp that the creation of the electrical contact between the current conductors of the light source and the contacts of the lamp cap by welding or soldering is a comparatively labor-intensive and cumbersome process. This process is also made more difficult by the size of the light source, which leaves comparatively little space for achieving the contacting. In addition, welding or soldering is a process which is comparatively bad for the environment. An undesirable bending of the flexible current conductors may take place as a result of external forces, such as shocks and impacts, because the current conductors in the hollow lamp cap of the known lamp are not screened off from one another. This means that the known lamp has the additional disadvantage that there is a comparatively high risk of short-circuiting in that the current conductors approach one another too closely, or even touch one another, owing to the inadvertent bending.

SUMMARY OF THE INVENTION

It is an object of the invention to provide an electric lamp of the kind described in the opening paragraph which has a comparatively safe construction and which renders possible a simple assembly of the lamp.

According to the invention, this object is achieved in that an insulator body provided with connection conductors is accommodated in the lamp cap for electrically interconnecting the current conductors and the contacts of the lamp cap. The connection conductors are guided through the insulator body through respective channels. The channels are separated from one another. The current conductors and the connection conductors electrically connected thereto are mechanically screened from one another by the insulator body in this way. This renders the lamp comparatively safe because the risk of short-circuiting through the current conductors touching each other has been reduced. The channels in the insulator body comprise recesses. An end of the connection conductor, which comprises, for example, a ferrule, extends into this recess, while another end of the connection conductor is electrically connected to the contact of the lamp cap, for example by means of a resilient contact. The resilient contact has the advantage that the electrical connection between the connection conductor and the contact on the lamp cap can be achieved without welding or soldering. This simplifies lamp assembly and is better for the environment. The current conductor makes electrical contact with the connection conductor in that it is inserted as far as possible into the recess. The electrical contacting of the current conductor with the contact on the lamp cap via the connection conductor is thus achieved in a comparatively simple manner. This further simplifies the lamp assembly.

In an embodiment, the envelope is internally reflectorized between the neck and the light emission window. The reflector body thus formed has a concave light-concentrating portion with an optical center and is present between the neck and the light emission window. The light source is arranged axially in the optical center. The light generated by the light source can be formed into a beam and aimed in a simple manner by means of the reflector body of the reflector lamp thus obtained.

In an embodiment, the insulator body is made of synthetic resin, porcelain, glass, or a ceramic material. It is favorable for the use of the lamp at comparatively high temperatures when the insulator body is made of porcelain, glass, or ceramic material on account of the good temperature resistance of porcelain, glass, and ceramic material. If the lamp is to be used at comparatively low temperatures, the insulator body is preferably made of a synthetic resin because an insulator body of synthetic resin can be simply and inexpensively manufactured.

It is favorable for a reproducible position of the insulator body in the lamp cap when the insulator body is provided with a recess which cooperates with the lamp cap. The insulator body is secured in the lamp cap in that the lamp cap is indented into said recess. The insulator body and the lamp cap are locked thereby against a mutual rotation about the axis. Such a rotation may occur as a result of torsional forces, for example while the lamp is being screwed into or from a luminaire. In addition, the assembly of the electric lamp is further simplified thereby because an additional position definition of the insulator body in the lamp cap with respect to the light source is avoided. Furthermore, the risk is reduced that short-circuits may arise between the current conductors in the lamp cap owing to a rotation of the insulator body with respect to the lamp cap.

In a favorable embodiment of the electric lamp, the connection conductor comprises a first end which is chosen from a group formed by resilient clamps and scraping contacts. The advantage of such a first end is that it has a clamping and fixing action whereby the current conductor is retained therein. The risk that the electrical contact between the current conductor and the contact on the lamp cap will be broken is reduced in this manner.

The light source in the known lamp is aligned and fixed in the neck of the envelope by means of cement, for example lamp cement. It is a disadvantage in the case of a reflector lamp, however, that cement, also after curing, evolves volatile components which may reduce the reflecting power of the reflector body. In the lamp according to the invention, the use of cement for this purpose is avoided because a reproducible fixed position of the insulator body in the lamp cap is achieved in that the insulator body is enclosed with narrow fit in the lamp cap. For this purpose, the insulator body may have, for example, a helically threaded surface, in which case the insulator body can be screwed into the lamp cap, which comprises a helically threaded contact, in a rotational movement. Since the insulator body is fixed in the lamp cap, it has become possible to fix the light source aligned in the reflector lamp in conjunction with the clamping/fixing first end. A yet further simplification in the lamp assembly is achieved as well thereby.

In a further favorable embodiment of the electric lamp, at least one connection conductor comprises at the same time one contact of the lamp cap. Since a separate welding or soldering operation for the electrical connection of the connection conductor and the contact of the lamp cap is avoided, the assembly of the lamp is still further simplified and has a lesser impact on the environment. In addition, an even more reliable electrical contacting is achieved in this way.

The light source may be an incandescent body, possibly in an atmosphere comprising halogen, or a discharge path between electrodes in an ionizable medium, for example metal halides in rare gas, possibly with mercury. The lamp vessel may be made from glass, for example hard glass or glass with an $SiO_2$ content of at least 95% by weight such as, for example, quartz glass, or monocrystalline or polycrystalline material such as, for example, aluminum oxide. The lamp vessel may be surrounded by an outer bulb.

The reflector lamp may be provided with a light-transmitting cover which is fastened to the reflector body and which closes off the light emission window.

BRIEF DESCRIPTION OF THE DRAWINGS

An embodiment of the lamp according to the invention is shown in the drawing, in which.

DETAILED DESCRIPTION OF THE PREFERRED EMBODIMENTS

Figure 1:
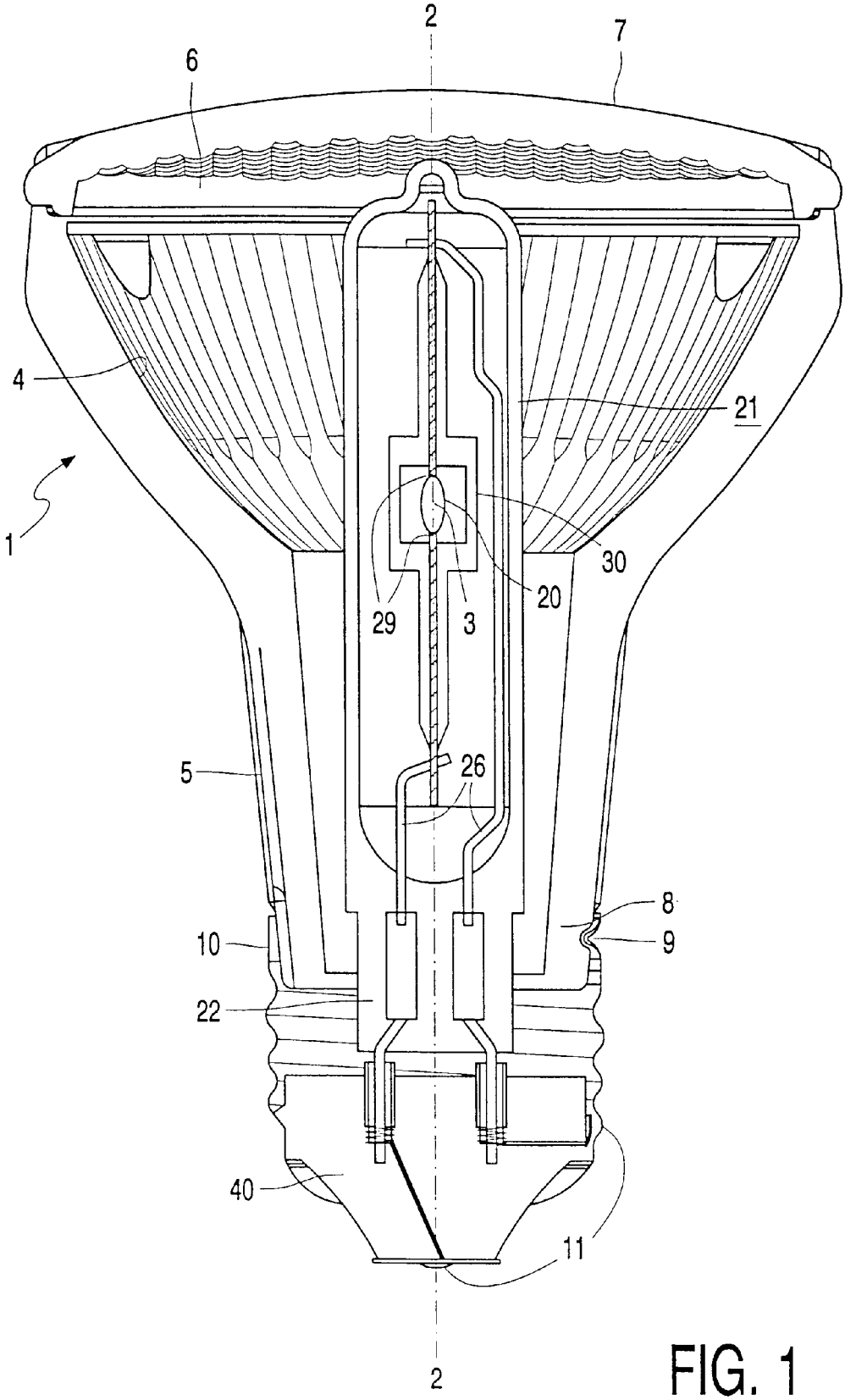
FIG. 1 shows a lamp in axial sectional view with the lamp cap broken away.

In FIG. 1, the electric lamp is a reflector lamp with an envelope 1 of a light-transmitting material, of molded glass in the Figure which is internally partly reflectorized. The reflector body 1 thus obtained has a concave light-concentrating portion 4 between a neck 5 and a light emission window 6, and an axis 2 and an optical center 3. The reflector body may be reflectorized by means of a metal layer, for example of silver or aluminum, or alternatively an interference filter. The light-concentrating portion is the body of revolution of a branch of a parabola which has been pivoted towards the axis with its focus in the optical center. A light-transmitting glass cover 7 is fastened, by means of epoxy resin in the Figure to the reflector body, thus closing off the light emission window 6. A lamp cap 10 provided with contacts 11 is fixed around a free end portion 8 of the neck 5 in that it has been indented into recesses 9. Alternatively, however, the lamp cap may be fixed by means of an adhesive, for example a glue. A light source 20 present in a light-transmitting outer bulb 21, made of quartz glass in the Figure and closed in a gastight manner, is axially arranged in the optical center 3. The light source in the Figure is a discharge path between tips 29 of the current conductors 26 acting as electrodes in a ceramic lamp vessel 30 filled with rare gas, mercury, and metal halides. Current conductors 26 extend from the light source 20 through a seal 22 of the outer bulb 21 and through the free end portion of the neck 5 to an insulator body 40 accommodated in the lamp cap 10 and are electrically connected to the contacts 11 of the lamp cap 10.

Figure 2:
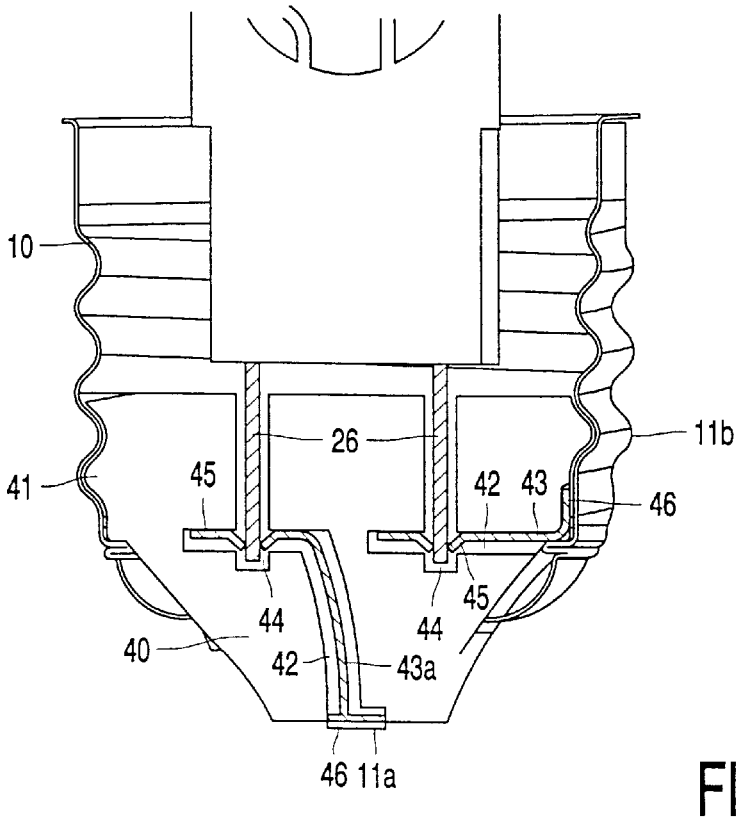
FIG. 2 is an axial sectional view of a detail of the lamp cap of FIG. 1.

FIG. 2 shows the insulator body 40 which is manufactured from a ceramic material, for example aluminum oxide, and which is provided with narrow fit in the lamp cap 10. The insulator body 40 is for this purpose provided with a threaded portion 41 whose shape corresponds to the shape of a threaded portion 11*b* of the lamp cap 10. The insulator body 40 comprises channels 42 in which respective connection conductors 43 are present. Each channel 42 comprises a recess 44 into which a first end 45 of the relevant connection conductor extends. The connection conductor in the Figure comprises a scraping contact as its first end 45. The current conductors 26 inserted into the respective recesses 44 are passed through the first ends 45 of the connection conductors 43, 43*a* and are fixed therein owing to the scraping action of the scraping contacts. The connection conductors 43, 43*a* make electrical contact by their second ends 46 with the contacts 11*a* and 11*b* of the lamp cap 10. In the Figure the connection conductor 43*a* comprises the centrally situated contact 11*a* of the lamp cap 10, while the second end 46 of the connection conductor 43 makes resilient contact with the contact 11*b*. The channels 42 of the isolator 40 and the connection conductors 43 have corresponding, but relatively small deviating shapes, as to enable a simple insertion of the connection conductors 43 into the isolator body 40 by a transversal movement. Self-clamping of these connection conductors 43 in the isolator body 40 is obtained due to the small deviating shapes and the resiliency of the connection conductors 43.

Figure 3:
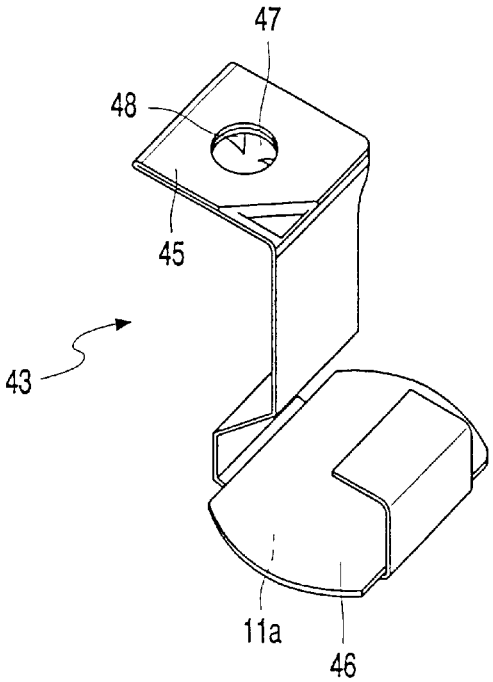
FIG. 3 is a connection conductor in side elevation.

FIG. 3 shows the connection conductor 43 having the second end 46 and the scraping contact 45 as the first end. The second end 46 is shaped as the centrally situated contact 11*a*. The scraping contact 45 comprises a rounded opening 47. Due to the dents 48, a current conductor (not shown) that passes through the opening 47 is fixed therein owing to the resilient scraping action of the dents 48 on the current conductor. Thus a reliable electric contact is realized between the current conductor and the connection conductor 43 comprising the integral centrally situated contact 11*a*.

What is claimed is:

1. An electric lamp comprising:

an envelope of a light-transmitting material with a neck, and a light source;

a lamp cap provided with contacts and fixed around a free end portion of the neck; and current conductors extending from the light source through the free end portion of the neck, an insulator body provided with and guiding connection conductors, the insulator body and connection conductors being accommodated within the lamp cap, at least one of the connection conductors electrically interconnecting a respective one of the current conductors and a respective one of the contacts of the lamp cap.

2. An electric lamp as claimed in claim 1, wherein the envelope is internally reflectorized between the neck and the light emission window.

3. An electric lamp as claimed in claim 1, wherein the insulator body is made of a material chosen from a group formed by synthetic resin, porcelain, glass, and ceramic material.

4. An electric lamp as claimed in claim 1, wherein the insulator body is provided with at least one recess co-operating with the lamp cap for fixing the insulator body in the lamp cap in that the latter is indented into said recess.

5. An electric lamp as claimed in claim 1, the insulator body comprising channels, said channels guiding the connection conductors through the insulator body, said channels further comprising recesses, the current conductors being insertable into said recesses.

6. An electric lamp as claimed in claim 1, wherein the insulator body is provided with narrow fit in the lamp cap for the purpose of fixing the insulator body in the lamp cap.

7. An electric lamp as claimed in claim 1, wherein at least one connection conductor comprises at the same time one contact of the lamp cap.

8. An electric lamp comprising:

an envelope of a light-transmitting material with a neck, and a light source;

a lamp cap provided with contacts and fixed around a free end portion of the neck;

current conductors extending from the light source through the free end portion of the neck, the current conductors being electrically connected to the contacts of the lamp cap;

an insulator body provided with connection conductors, the connection conductors being accommodated in the lamp cap and capable of electrically interconnecting the current conductors and the contacts of the lamp cap, at least one of the connection conductors comprising a first end which is chosen from a group formed by resilient clamps and scraping contacts.

9. An electric lamp comprising:

an envelope of a light-transmitting material with a neck, the envelope enclosing a light source;

a lamp cap provided with first and second contacts and fixed around an end portion of the neck;

first and second current conductors extending from the light source through the end portion of the neck; and an insulator body accommodated in the lamp cap, the insulator body being provided with first and second connection conductors, the first and second connection conductors being held in position and electrically and mechanically separated from each other by the insulator body, said first and second connection conductors, respectively, electrically contacting the first and second contacts of the lamp cap, the first current conductor being mechanically and electrically connected to the first connection conductor, the second current conductor being mechanically and electrically connected to the second connection conductor.

10. An electric lamp comprising:

an envelope of a light-transmitting material with a neck, and a light source;

a lamp cap provided with first and second contacts and fixed around an end portion of the neck, the lamp cap at least partially enclosing a space;

an insulator body occupying all or part of the space;

current conductors extending from the light source through the end portion of the neck;

connection conductors within the space, at least one of the connection conductors being attachable to a respective one of the current conductors and to a respective one of the contacts, to electrically interconnect the respective one of the current conductors with the respective one of said contacts, the connection conductors being held in a reproducible fixed position, the insulating body maintaining a separation, from a current conductor, of said at least one of the connection conductors and the respective one of the current conductors, the insulator body comprising channels, said channels guiding the connection conductors through the insulator body, said channels further comprising recesses, the current conductors being insertable into said recesses.

* * * * *